US008337230B1

(12) United States Patent
Kurachi

(10) Patent No.: US 8,337,230 B1
(45) Date of Patent: Dec. 25, 2012

(54) ELECTRICAL CONNECTOR

(75) Inventor: Takaki Kurachi, Tokyo (JP)

(73) Assignee: Dai-Ichi Seiko Co., Ltd. (JP)

( * ) Notice: Subject to any disclaimer, the term of this patent is extended or adjusted under 35 U.S.C. 154(b) by 0 days.

(21) Appl. No.: 13/221,764

(22) Filed: Aug. 30, 2011

(51) Int. Cl.
*H01R 12/00* (2006.01)

(52) U.S. Cl. ..... 439/328; 439/358

(58) Field of Classification Search ..... 439/328, 439/325, 353, 358
See application file for complete search history.

(56) References Cited

U.S. PATENT DOCUMENTS

| | | | | |
|---|---|---|---|---|
| 6,679,713 | B2 | 1/2004 | Miura | |
| 7,387,528 | B2 * | 6/2008 | Lee et al. | 439/495 |
| 7,407,408 | B1 * | 8/2008 | Taylor | 439/449 |
| 7,510,424 | B2 * | 3/2009 | Mundt | 439/492 |
| 7,833,041 | B2 * | 11/2010 | Ono et al. | 439/329 |
| 7,892,002 | B2 * | 2/2011 | Shen et al. | 439/260 |
| 2003/0060072 | A1 | 3/2003 | Miura | |
| 2010/0099292 | A1 * | 4/2010 | Shen et al. | 439/338 |
| 2010/0291790 | A1 * | 11/2010 | Kiryu et al. | 439/374 |

FOREIGN PATENT DOCUMENTS

| | | | |
|---|---|---|---|
| JP | 2003-100370 | A | 4/2003 |
| JP | 2008-277068 | A | 11/2008 |
| JP | 2009-158272 | A | 7/2009 |
| JP | 2009-231069 | A | 10/2009 |

* cited by examiner

*Primary Examiner* — Neil Abrams
*Assistant Examiner* — Phuongchi Nguyen
(74) *Attorney, Agent, or Firm* — Studebaker & Brackett PC; Donald R. Studebaker

(57) ABSTRACT

An electrical connector including a housing provided thereon with an opening through which a flat circuit device is inserted into the housing, a plurality of conductive contacts arranged on the housing, and a holding member attached to the housing to be operative to hold the flat circuit device inserted in the housing and then to release the flat circuit device from holding by the holding member, wherein the holding member has a base portion fixed to the housing and a movable arm portion extending from the base portion, and the movable arm portion is provided thereon with an engaging portion operative to be put in engagement with the flat circuit device inserted in the housing so as to hold the same and a releasing portion protruding from the movable arm portion to the outside of the housing and is operative to move for releasing the engaging portion from the engagement with the flat circuit device when the releasing portion is manipulated to be shifted in position.

7 Claims, 9 Drawing Sheets

ELECTRICAL CONNECTOR

BACKGROUND OF THE INVENTION

1. Field of the Invention

The present invention relates generally to an electrical connector, and more particularly to an improvement in an electrical connector which has a housing, a plurality of conductive contacts arranged on the housing for coming into contact with connecting terminals provided on a flat circuit device, such as a flexible printed circuit board (hereinafter, referred to as an FPC) or a flexible flat cable assembly (hereinafter, referred to as an FFC) inserted in the housing, and holding means for engaging with the flat circuit device inserted in the housing to hold the same and for disengaging the flat circuit device from holding by the holding meas.

2. Description of Related Art including information disclosed under 37 CFR 1.97 and 37 CFR 1.98

A flat circuit device, such as a relatively small-sized FPC or FFC, used in electronic apparatus of various kinds is often mounted on a main solid circuit board, on which various electrical parts are directly mounted, with an electrical connector which is fixed to and connected electrically with the main solid circuit board. The electrical connector thus used has a plurality of conductive contacts, an end portion of each of which is connected electrically with a conductive circuit pattern portion formed on the main solid circuit board and which are provided for coming into contact with connecting terminals provided on the flat circuit device, and is operative to cause each of the connecting terminals provided on the flat circuit board to be connected electrically through the conductive contact with the conductive circuit pattern portion formed on the main solid circuit board.

A first type of previously proposed electrical connector used for connecting a flat circuit device, such as an FPC, with a main solid circuit board, has a housing made of insulator, which is mounted on the main solid circuit board and has an opening through which at least a part of the flat circuit device is inserted into the housing. On the housing, a plurality of conductive contacts are provided to be arranged along the opening and connected electrically with circuit terminals provided on the main solid circuit board. These conductive contacts are operative to come into contact respectively with a plurality of connecting terminals provided on a flat circuit device when the flat circuit device is inserted into the housing through the opening provided thereon. The previously proposed electrical connector of the first type has also an actuator which is provided to be rotatable in regard to the housing so as to engage with each of the conductive contacts arranged on the housing or to come into contact with the flat circuit device inserted in the housing. The actuator is operative to move an operating portion of each of the conductive contacts so that each of the conductive contacts is put in press-contact with a corresponding one of the connecting terminals provided on the flat circuit device inserted in the housing when the actuator is rotated in a first direction in regard to the housing and to allow the operating portion of each of the conductive contacts to move so that each of the conductive contacts is released from the press-contact with the connecting terminal when the actuator is rotated in a second direction opposite to the first direction in regard to the housing, or to push the flat circuit device inserted in the housing so that each of the connecting terminals provided on the flat circuit device is put in press-contact with a corresponding one of the conductive contacts arranged on the housing when the actuator is rotated in a first direction in regard to the housing and to cease to push the flat circuit device so that each of the connecting terminals provided on the flat circuit device is released from the press-contact with the conductive contact when the actuator is rotated in a second direction opposite to the first direction in regard to the housing. With the conductive contacts arranged on the housing put in press-contact with the connecting terminals provided on the flat circuit device, the flat circuit device is put in electrical connection with the main solid circuit board.

A second type of previously proposed electrical connector used for connecting a flat circuit device with a main solid circuit board has a housing to be mounted on the main solid circuit board and a plurality of conductive contacts in the same manner as the previously proposed electrical connector of the first type mentioned above and in addition a conductive shell which covers partially the housing and is grounded to be operative to contribute to adjustment on characteristic impedance of each of the conductive contacts and to shield the conductive contacts in the housing from electromagnetic wave noises coming from the outside, but does not have an actuator which is rotatable in regard to the housing as mentioned above. In the previously proposed electrical connector of the second type, when a flat circuit device is inserted into the housing through an opening provided thereon, each of the conductive contacts provided in the housing to be arranged along the opening is automatically put in contact with a corresponding one of connecting terminals provided on the flat circuit device. That is, the flat circuit device is put in electrical connection with the main solid circuit board by means of only inserting correctly the flat circuit device into the housing through the opening provided thereon.

In the above-mentioned previously proposed electrical connector with or without the actuator rotatable in regard to the housing, when the flat circuit device is inserted into the housing through the opening provided thereon and the conductive contacts arranged on the housing are put in press-contact with the connecting terminals provided on the flat circuit device so that the flat circuit device is put in electrical connection with the main solid circuit board, it is required to prevent the flat circuit device inserted in the housing from getting out of the housing unwillingly. It is a matter of course that it is necessary for the flat circuit device inserted in the housing to be held stably so as not to get out of the housing unwillingly in order to keep the conductive contacts arranged on the housing properly in a condition of contact with the connecting terminals provided on the flat circuit device.

Accordingly, there has been also proposed previously an electrical connector belonging to the above-described first type having the housing, the conductive contact and the actuator, which is provided with holding means for engaging with a flat circuit device, such as an FPC or FFC, inserted in the housing so as to hold the same to be prevented from getting out of the housing unwillingly, as shown in, for example, the Japanese patent application published before examination under publication number 2003-100370 (hereinafter, referred to as published patent document 1).

In addition, there has been further proposed previously an electrical connector belonging to the above-described second type having the housing, the conductive contact and the conductive shell, which is provided with holding means for engaging with a flat circuit device, such as an FPC or FFC, inserted in the housing so as to hold the same to be prevented from getting out of the housing unwillingly, as shown in, for example, the Japanese patent application published before examination under publication number 2009-231069 (hereinafter, referred to as published patent document 2).

In the electrical connector shown in the published patent document 1, a couple of reinforcing metal members (20) are attached respectively to end portions of the housing (2) aligned in a direction along which the conductive contacts (contacts (6)) are arranged. Each of the reinforcing metal members (20) is provided with the holding means (a resilient supporting arm portion (25)) which is operative to come into contact with the flat circuit device (a flexible circuit board (30)) inserted in the housing through an opening (3) provided thereon to push the same up or to engage with an engaging portion (an engaging opening or notch (32)) provided on the flat circuit device. When the actuator (a pressure member (12)) which is provided to be rotatable in regard to the housing is rotated from a first position at which the actuator keeps rising from the housing to a second position at which the actuator keeps lying down on the housing, the flat circuit device inserted in the housing is pushed by the actuator to the holding means formed in the reinforcing metal member.

As a result, the flat circuit device inserted in the housing is put between the actuator and the holding means formed in the reinforcing metal member to be held thereby or the flat circuit device inserted in the housing is directly held by the holding means formed in the reinforcing metal member which is put in engagement with the engaging portion provided on the flat circuit device, so as to be prevented from getting out of the housing unwillingly.

Then, when the actuator is rotated from the second position at which the actuator keeps lying down on the housing to the first position at which the actuator keeps rising from the housing, the flat circuit device inserted in the housing is ceased to be pushed by the actuator and released from a condition wherein the flat circuit device is put between the actuator and the holding means formed in the reinforcing metal member to be held thereby or the flat circuit device is directly held by the holding means formed in the reinforcing metal member which is put in engagement with the engaging portion provided on the flat circuit device, so as to be able to get out of the housing.

In the electrical connector shown in the published patent document 2, the conductive shell (an ejecting plate (8)) is provided to be able to slide in regard to the housing (an insulated housing (5)). The conductive shell is resiliently forced by a resilient member (7), such as a coil spring or the like, put between the conductive shell and the housing in a first direction opposite to a second direction along which the flat circuit device (an FPC (2)) is inserted into the housing. A couple of holding means (resilient holding nail members (6)) are attached respectively to end portions of the housing aligned in a direction along which the conductive contacts (contact pins (4)) are arranged. Each of the holding means is provided at a top end portion thereof with a holding portion (6*c*) for engaging with an engaging portion (a recess (2*d*)) provided on the flat circuit device inserted in the housing through an opening (3) provided thereon, so as to constitute a locking device for locking the flat circuit device.

Further, an ejecting projection (6*d*) is formed on each of the holding means to be put in an opening formed on the conductive shell. A tapered portion (8*a*) of the opening formed on the conductive shell engages with the ejecting projection formed on the holding means when the conductive shell is moved to slide in regard to the housing.

Then, when the flat circuit device is inserted into the housing through the opening provided thereon under a condition wherein the ejecting projection formed on each of the holding means is put in the opening formed on the conductive shell and the tapered portion of the opening formed on the conductive shell does not engage with the ejecting projection, the holding portion of each of the holding means engages with the engaging portion provided on the flat circuit device to hold the flat circuit device. As a result, the flat circuit device inserted in the housing is held by the holding means to be prevented from getting out of the housing unwillingly.

After that, when the conductive shell is moved to slide in regard to the housing in the second direction along which the flat circuit device is inserted into the housing against the resilient force exerted by the resilient member by which the conductive shell is resiliently forced in the first direction opposite to the second direction, the tapered portion of the opening formed on the conductive shell engages with the ejecting projection formed on each of the holding means to push the same. Thereby, the holding means is so moved as to cause the holding portion of the holding means to disengage from the engaging portion provided on the flat circuit device. As a result, the flat circuit device is put in a condition to be able to get out of the housing.

In each of the electrical connectors thus proposed previously, which is provided with the holding means operative to prevent the flat circuit device inserted in the housing from getting out of the housing unwillingly, the holding means operative to be put in operation to prevent the flat circuit device inserted in the housing from getting out of the housing unwillingly is provided to shift its position in response to rotational movements of the actuator provided to be rotatable in regard to the housing or the conductive shell for covering partially the housing is provided to be movable in regard to the housing and the holding means operative to be put in operation to prevent the flat circuit device inserted in the housing from getting out of the housing unwillingly is attached to the housing for engaging with the conductive shell.

In the case of the previously proposed electrical connector which has the holding means operative to shift its position in response to the rotational movements of the actuator provided to be rotatable in regard to the housing, the actuator provided to be rotatable in regard to the housing is positively required and this results in problems or disadvantages that the number of constitutive parts of the electrical connector increases undesirably and a production cost of the electrical connector rises disagreeably. In addition, it is necessary for causing the holding means to engage with or disengage from the flat circuit device inserted in the housing to rotate the actuator in regard to the housing. This results in undesirable increase in an open space around the electrical connector.

In the case of the previously proposed electrical connector which has the conductive shell provided to be movable in regard to the housing and the holding means attached to the housing for engaging with the conductive shell, since the conductive shell is operative to move in regard to the housing, any part of the conductive shell can not be used for fastening the electrical connector to the main solid circuit board so that a separate holding-down member for fastening the electrical connector to the main solid circuit board is positively required. This results in problems or disadvantages that the number of constitutive parts of the electrical connector increases undesirably and a production cost of the electrical connector rises disagreeably.

Further, in the electrical connector thus constituted to have the conductive shell provided to be movable in regard to the housing, a specific mechanism by which the conductive shell is supported to be movable in regard to the housing is required. This results in complication in the constitution of the electrical connector and a further rise in the production cost of the electrical connector.

BRIEF SUMMARY OF THE INVENTION

Accordingly, it is an object of the present invention to provide an electrical connector used for connecting a flat circuit device, such as an FPC or FFC, with a solid circuit board, which comprises a housing provided with an opening through which a flat circuit device is inserted into the housing and a plurality of conductive contacts provided to be arranged on the housing, and which avoids the aforementioned problems or disadvantages encountered with the prior art.

Another object of the present invention is to provide an electrical connector used for connecting a flat circuit device, such as an FPC or FFC, with a solid circuit board, which comprises a housing provided with an opening through which a flat circuit device is inserted into the housing and a plurality of conductive contacts provided to be arranged on the housing, and in which the flat circuit device inserted in the housing can be surely put in holding to be prevented from getting out of the housing unwillingly and then released from the holding so as to be able to get out of the housing with a relatively small number of constitutive parts resulting in a reduced production cost of the electronic connector.

A further object of the present invention is to provide an electrical connector used for connecting a flat circuit device, such as an FPC or FFC, with a solid circuit board, which comprises a housing provided with an opening through which a flat circuit device is inserted into the housing and a plurality of conductive contacts provided to be arranged on the housing, and in which the flat circuit device inserted in the housing can be surely put in holding to be prevented from getting out of the housing unwillingly and then released from the holding so as to be able to get out of the housing with none of an actuator provided to be rotatable in regard to the housing and a conductive shell provided to be movable in regard to the housing.

According to the present invention, as claimed in any one of claims, there is provided an electrical connector, which comprises a housing made of insulator to be mounted on a solid circuit board and provided thereon with an opening through which a flat circuit device, such as an FPC or FFC, is inserted into the housing, a plurality of conductive contacts arranged on the housing to be electrically connected respectively with circuit terminals provided on the solid circuit board and positioned to correspond respectively to connecting terminals provided on the flat circuit device inserted in the housing through the opening provided thereon, and a holding member attached to the housing to be operative to hold the flat circuit device inserted in the housing through the opening provided thereon and then to release the flat circuit device from holding by the holding member, wherein the holding member has a base portion provided to be fixed to the housing and a movable arm portion extending from the base portion, and the movable arm portion is provided thereon with an engaging portion operative to be put in engagement with the flat circuit device inserted in the housing so as to hold the same and a releasing portion protruding from the movable arm portion to the outside of the housing and is operative to move for releasing the engaging portion from the engagement with the flat circuit device when the releasing portion is manipulated to be shifted in position.

Especially, in a first example of electronic connector according to the present invention, the holding member is made of metallic material to have a board connecting portion provided for extending from the base portion to the outside of the housing to be soldered to a conductive portion provided on the solid circuit board on which the housing is mounted.

Further, in a second example of electronic connector according to the present invention, a depression is formed at a part of an external surface portion of the housing from which the releasing portion provided on the movable arm portion of the holding member protrudes to the outside of the housing.

In the electrical connector thus constituted in accordance with the present invention, when the flat circuit device is inserted into the housing through the opening provided thereon, each of the conductive contacts provided to be arranged on the housing comes into contact with a corresponding one of the connecting terminals provided on the flat circuit device inserted in the housing and the holding member attached to the housing engages with the flat circuit device inserted in the housing to hold the same. As a result, the flat circuit device inserted in the housing is prevented from getting out of the housing unwillingly.

Then, when the holding member is manipulated in a predetermined manner under a condition wherein the flat circuit device inserted in the housing is held by the holding member, the holding member is operative to release the flat circuit device from the holding by the holding member in the housing. As a result, the flat circuit device inserted in the housing is put in a condition to be able to get out of the housing.

The holding member thus provided in the electrical connector according to the invention has the base portion provided to be fixed to the housing and the movable arm portion extending from the base portion. On the movable arm portion, the engaging portion and the releasing portion are provided. The engaging portion is operative to engages with the flat circuit device inserted in the housing to hold the same. The releasing portion is formed to protrude from the movable arm portion to the outside of the housing and is operative to cause the movable arm portion to move for releasing the engaging portion from the engagement with the flat circuit device when it is manipulated to be shifted in its position.

The holding member employed, for example, in the first example of electrical connector as mentioned above, is made of metallic material to have the board connecting portion provided for extending from the base portion to the outside of the housing. The board connecting portion is soldered to the conductive portion provided on the solid circuit board on which the housing is mounted.

Further, the housing employed, for example, in the second example of electrical connector as mentioned above, is provided with the depression formed at the part of the external surface portion thereof from which the releasing portion provided on the movable arm portion of the holding member protrudes to the outside of the housing.

With the electrical connector thus constituted in accordance with the present invention, as described above, it is not required, for causing the holding member attached to the housing to hold the flat circuit device inserted in the housing for preventing the same from getting out of the housing unwillingly and then to release the flat circuit device from the holding by the holding member for putting the same in the condition to be able to get out of the housing, to provide on the housing an actuator rotatable in regard to the housing or to provide on the housing a conductive shell movable in regard to the housing. As a result, the electrical connector according to the present invention can be constituted with a relatively small number of constitutive parts and at a production cost reduced effectively.

In the electrical connector according to the present invention, the holding member, which is provided for holding the flat circuit device inserted in the housing through the opening provided thereon and then for releasing the flat circuit device from the holding by the holding member, is constituted to have the base portion provided to be fixed to the housing and the movable arm portion extending from the base portion, and the movable arm portion is provided thereon with the engaging portion operative to be put in engagement with the flat circuit device inserted in the housing so as to hold the same and a releasing portion protruding from the movable arm portion to the outside of the housing for causing the movable arm portion to move for releasing the engaging portion from the engagement with the flat circuit device when the releasing portion is manipulated to be shifted in its position. Therefore, the holding member can be obtained with a relatively simplified constitution in which the engaging portion and the releasing portion are formed in a body.

Further, in the electrical connector according to the present invention, since the engaging portion of the holding member is automatically put in the engagement with the flat circuit device to hold the same in the housing when the flat circuit device is inserted in the housing through the opening provided thereon and then the engaging portion of the holding member is released from the engagement with the flat circuit device inserted in the housing when the releasing portion of the holding member protruding to the outside of the housing is manipulated, for example, to be pushed toward the inside of the housing, the flat circuit device inserted in the housing can be held by the holding member and then released from the holding by the holding member in the housing with extremely simple and easy operations and it is not necessary for carrying out such operations to provide an undesirable open space around the releasing portion of the holding member.

Especially, in the first example of electrical connector according to the present invention, since the holding member is made of metallic material to have the board connecting portion provided for extending from the base portion to the outside of the housing so as to be soldered to the conductive portion provided on the solid circuit board on which the housing is mounted, the board connecting portion of the holding member can be operative to contribute to firm mounting of the housing on the solid circuit board.

Besides, in the second example of electrical connector according to the present invention, since the depression is formed at the part of the external surface portion of the housing from which the releasing portion of the holding member protrudes to the outside of the housing, it is possible to limit the releasing portion so as not to project beyond a portion of the external surface portion of the housing positioned around the depression. Further, it is also possible to confirm a situation in which the flat circuit device inserted in the housing is surely and appropriately held by the holding member with visual observation of the releasing portion of the holding member protruding to the outside of the housing in the depression. In addition, the releasing portion of the holding member can be easily manipulated in the depression.

The above, and other objects, features and advantages of the present invention will become apparent from the following detailed description taken in conjunction with the accompanying drawings.

DETAILED DESCRIPTION OF THE INVENTION

Figure 1:
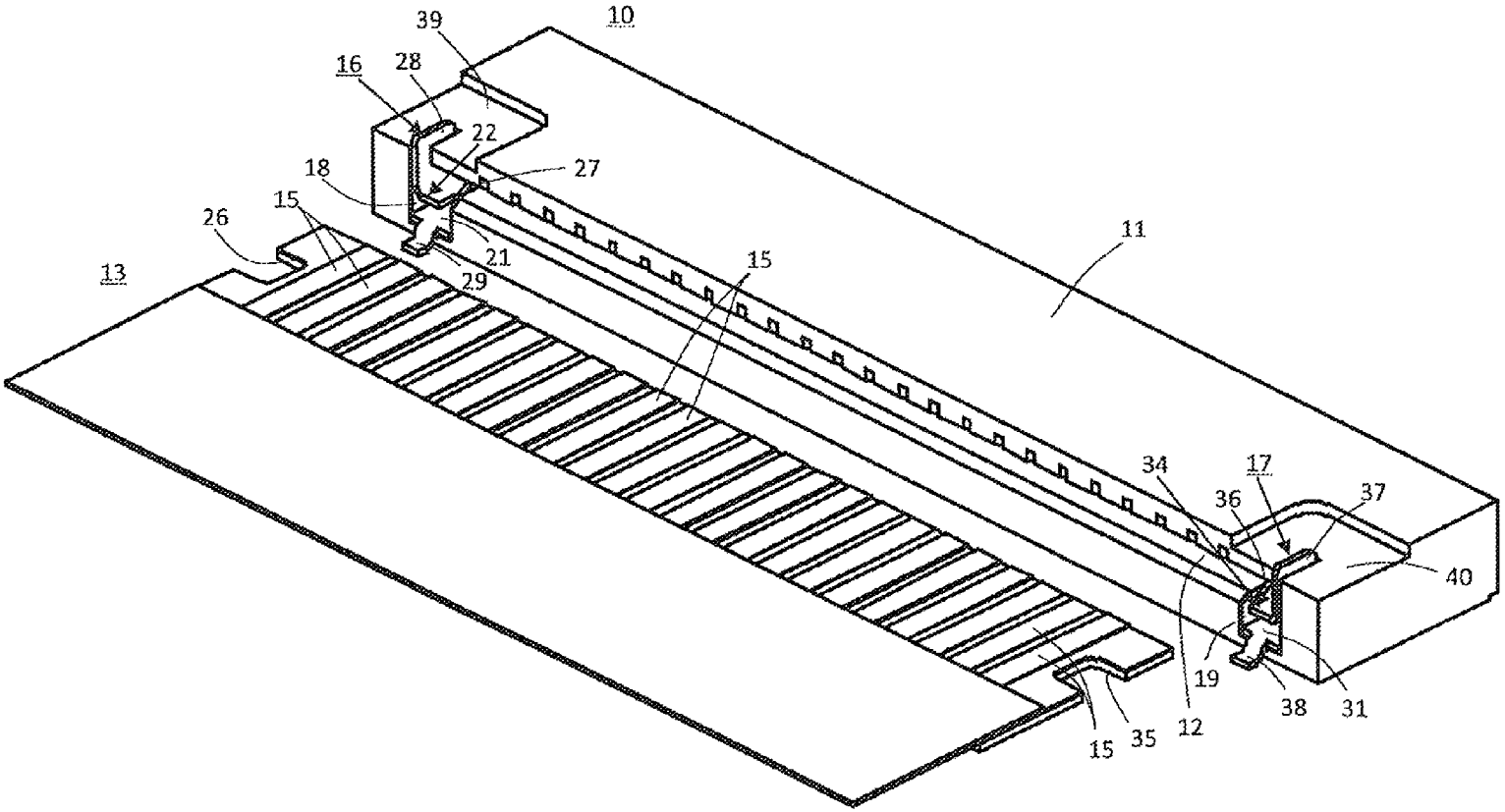
FIG. 1 is a schematic front, top and right side perspective view showing an embodiment of electrical connector according to the present invention, together with an FPC which is to be inserted into the housing of the embodiment.
Figure 2:
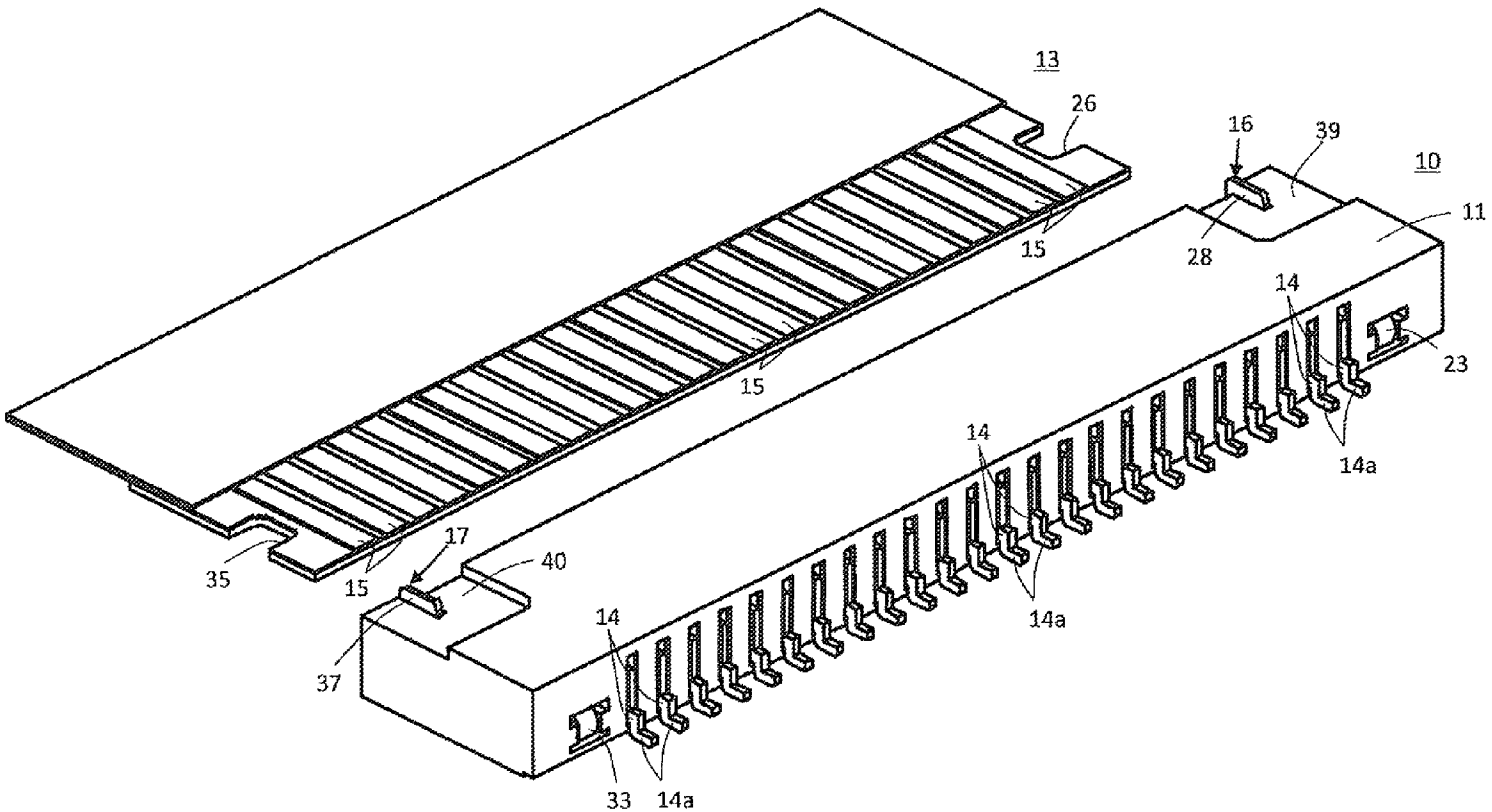
FIG. 2 is a schematic rear, top and left side perspective view showing the embodiment shown in FIG. 1, together with the FPC which is to be inserted into the housing of the embodiment.
Figure 3:
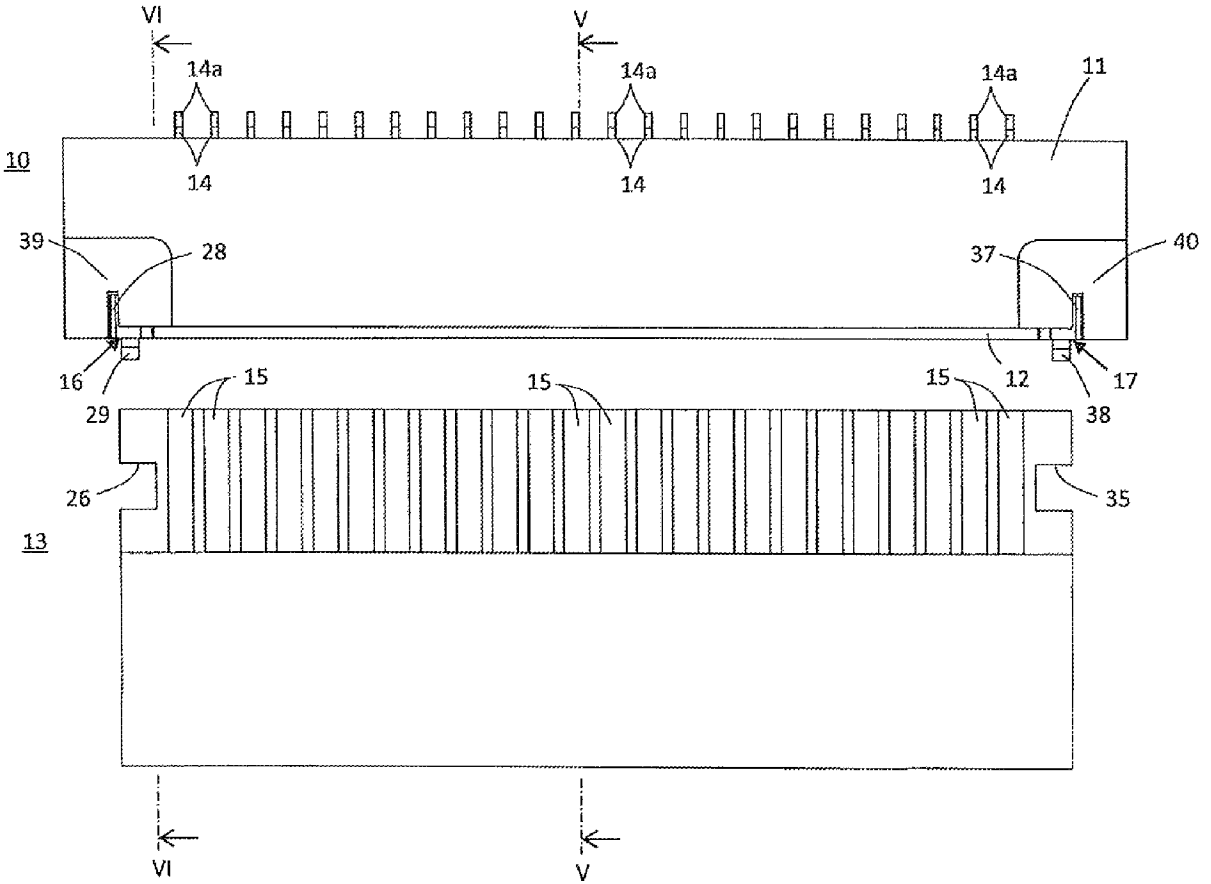
FIG. 3 is a schematic plan view showing the embodiment shown in FIG. 1, together with the FPC which is to be inserted into the housing of the embodiment.

Each of FIG. 1 which is a schematic front, top and right side perspective view, FIG. 2 which is a schematic rear, top and left side perspective view and FIG. 3 which is a plan view, shows an embodiment of electrical connector according to the present invention, together with an FPC which is provided to be inserted into the embodiment.

Referring to FIGS. 1 to 3, an electrical connector 10, which constitutes the embodiment of electrical connector according to the present invention, has a housing 11 made of insulator, such as plastics or the like. The housing 11 is provided on a front end portion thereof with an opening 12 through which a flat circuit device, such as an FPC, is inserted into the housing 11. In the housing 11, a room extending from the opening 12 is formed for accommodating the flat circuit device inserted through the opening 12 into the housing 11.

The housing 11 has a first end surface portion which is an outer surface portion of a lower or bottom end of the housing 11 in FIGS. 1 to 3 and a second end surface portion which is an outer surface portion of an upper or top end of the housing 11 in FIGS. 1 to 3 and opposite to the first end surface portion. Hereinafter, the first end surface portion is referred to as a lower external surface portion and the second end surface portion is referred to as an upper external surface portion. When the electrical connector 10 is put in practical use, the housing 11 is mounted on a solid circuit board (not shown in the drawings) with the lower external surface portion facing the solid circuit board and the upper external surface portion positioned to be open to a space on the solid circuit board, and, for example, an FPC 13 constituting the flat circuit device is inserted into the housing 11 through the opening 12 provided thereon.

A plurality of conductive contacts 14, each of which is made of resilient conductive material, are provided on the housing 11 to be arranged in a longitudinal direction of the housing 11. That is, a direction along which the conductive contacts 14 are arranged is the longitudinal direction of the housing 11. Each of the conductive contacts 14 constitutes, for example, a signal contact operative to come into contact with a signal connecting terminal provided on the FPC 13. It is also possible for the conductive contacts 14 to include, in addition to the signal contacts, one or more ground contacts operative to come into contact with a ground connecting portion provided on the FPC 13.

Further, each of the conductive contacts 14 has a connecting terminal portion 14*a* projecting from a rear end portion of the housing 11 to the outside of the housing 11, as shown in FIG. 2. The connecting terminal portion 14*a* of the conductive contact 14 is connected electrically by means of soldering with one of circuit terminals provided on the solid circuit board on which the housing 11 is mounted. A main portion of each of the conductive contacts 14 is, for example, thrust into the housing 11 from the rear end portion thereof to be fixed in the housing 11 when the electrical connector 10 is assembled.

When the FPC 13 is inserted in the housing 11 through the opening 12 provided thereon, the conductive contacts 14 are come into contact respectively with a plurality of connecting terminals 15 arranged on the FPC 13, so that the connecting terminals 15 arranged on the FPC 13 inserted in the housing 11 are electrically connected through the conductive contacts 14 respectively with the circuit terminals provided on the solid circuit board on which the housing 11 is mounted.

A couple of holding members 16 and 17, each of which is made of metallic material, are attached respectively to both end portions in the longitudinal direction of the housing 11 to be fixed thereto. That is, the holding members 16 and 17 are attached to the housing 11 to be opposite to each other with the opening 12 between in the longitudinal direction of the housing 11.

The holding members 16 and 17 are put respectively in accommodating rooms 18 and 19 formed in the housing 11 to be operative to hold the FPC 13 inserted in the housing 11 through the opening 12 provided thereon and then to release the FPC 13 in the housing 11 from holding by the holding members 16 and 17 as occasion demands.

Figure 4:
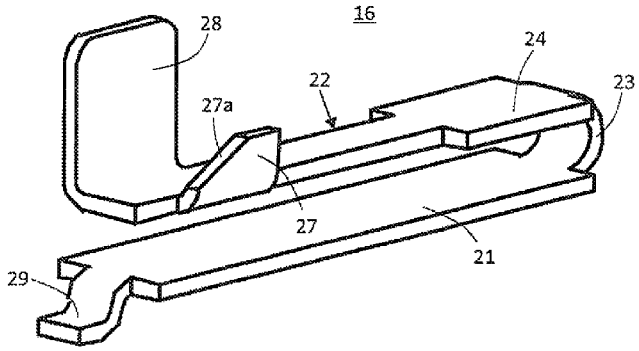
FIG. 4 is a schematic perspective view showing a holding member provided to be employed in the embodiment shown in FIG. 1.

As shown in FIG. 4, the holding member 16 is constituted, for example, with a resilient metallic thin plate subjected to a punch and bend processing to have a base portion 21 fixed to the housing 11 in the accommodating rooms 18 formed therein and a movable arm portion 22 extending from the base portion 21. The base portion 21 is connected through a holding-back portion 23 with the movable arm portion 22 so that the movable arm portion 22 faces the base portion 21 with a predetermined space between to be operative to swing for getting near to or away from the base portion 21.

The movable arm portion 22 is provided thereon with a contacting portion 24 extending from the holding-back portion 23 to be operative to come into contact with the housing 11, an engaging portion 27 operative to be put in engagement with an engaging edged recess 26 provided on the FPC 13 inserted in the housing 11 through the opening 12 provided thereon so as to hold the FPC 13, and a releasing portion 28 protruding from the movable arm portion 22 to the outside of the housing 11 for causing the movable arm portion 22 to move for disengaging the engaging portion 27 from the engagement with the engaging edged recess 26 provided on the FPC 13 so that the FPC 13 is released from holding by the engaging portion 27 when the releasing portion 28 is manipulated to be shifted in its position, for example, by pushing down.

The engaging portion 27 has a slanted end plane 27*a* formed thereon to ascends gradually in a direction along which the FPC 13 is inserted into the housing 11 through the opening 12 provided thereon and a part of the engaging portion 27 on which the slanted end plane 27*a* is formed is operative to engage directly with the engaging edged recess 26 provided on the FPC 13. When the FPC 13 is inserted into the housing 11 through the opening 12, a top end portion of the FPC 13 comes into contact with the slanted end plane 27*a* formed on the engaging portion 27 and the slanted end plane 27*a* is operative to guide the top end portion of the FPC 13 to ride across the engaging portion 27.

Further, the holding member 16 has also a board connecting portion 29 provided for extending from the base portion 21 to the outside of the front end portion of the housing 11. The board connecting portion 29 is soldered to a conductive portion provided on the solid circuit board on which the housing 11 is mounted so as to contribute to firm mounting of the housing 11 on the solid circuit board when the connecting terminal portion 14*a* of each of the conductive contacts 14, which projects from the rear end portion of the housing 11 to the outside of the housing 11, is connected electrically by means of soldering with one of the circuit terminals provided on the solid circuit board on which the housing 11 is mounted.

The holding member 17 is also constituted, for example, with a resilient metallic thin plate subjected to a punch and bend processing to have a constitution in minor-symmetry of the holding member 16. That is, the holding member 17 has a base portion 31 fixed to the housing 11 in the accommodating rooms 19 formed therein, which corresponds to the base portion 21 of the holding member 16, and a movable arm portion 34 extending from the base portion 31, which corresponds to the movable arm portion 22 of the holding member 16. The base portion 31 is connected through a holding-back portion 33 with the movable arm portion 34 so that the movable arm portion 24 faces the base portion 31 with a predetermined space between to be operative to swing for getting near to or away from the base portion 31.

The movable arm portion 34 is provided thereon with a contacting portion extending from the holding-back portion 33 to be operative to come into contact with the housing 11, which corresponds to the contacting portion 24 of the holding member 16, an engaging portion 36 operative to be put in engagement with an engaging edged recess 35 provided on the FPC 13 inserted in the housing 11 through the opening 12 provided thereon so as to hold the FPC 13, which corresponds to the engaging portion 27 of the holding member 16, and a releasing portion 37 protruding from the movable arm portion 34 to the outside of the housing 11 for causing the movable arm portion 34 to move for releasing the engaging portion 36 from the engagement with the engaging edged recess 35 provided on the FPC 13 so that the FPC is released from holding by the engaging portion 36 when the releasing portion 37 is manipulated to be shifted in its position, for example, by pushing down, which corresponds to the releasing portion 28 of the holding member 16.

The engaging portion 36 has a slanted end plane formed thereon to ascends gradually in a direction along which the FPC 13 is inserted into the housing 11 through the opening 12 provided thereon and a part of the engaging portion 36 on which the slanted end plane is formed is operative to engage directly with the engaging edged recess 35 provided on the FPC 13. When the FPC 13 is inserted into the housing 11 through the opening 12, the top end portion of the FPC 13 comes into contact also with the slanted end plane formed on the engaging portion 36 and the slanted end plane is operative to guide the top end portion of the FPC 13 to ride across the engaging portion 36.

Further, the holding member 17 has also a board connecting portion 38 provided for extending from the base portion 31 to the outside of the front end portion of the housing 11. The board connecting portion 38 is soldered to the conductive portion provided on the solid circuit board on which the housing 11 is mounted so as to contribute to firm mounting of the housing 11 on the solid circuit board when the connecting terminal portion 14*a* of each of the conductive contacts 14, which projects from the rear end portion of the housing 11 to the outside of the housing 11, is connected electrically by means of soldering with one of the circuit terminals provided on the solid circuit board on which the housing 11 is mounted.

The releasing portion 28 of the holding member 16, which protrudes from the movable arm portion 22 to the outside of the housing 11, has a top end thereof projecting from a corner of the upper external surface portion of the housing 11 to the outside thereof at the end portion of the housing 11 to which the holding member 16 is fixed. A depression 39 is formed at the corner of the upper external surface portion of the housing 11 from which the top end of the releasing portion 28 of the holding member 16 projects to the outside of the housing 11. With the depression 39 thus formed, it is possible to limit the releasing portion 28 so as not to project beyond a portion of the upper external surface portion of the housing 11 positioned around the depression 39. Further, it is also possible to confirm a situation in which the FPC 13 inserted in the housing 11 is surely and appropriately held by the engaging portion 27 of the holding member 16 with visual observation of or finger touch to the top end of the releasing portion 28 of the holding member 16 projecting to the outside of the housing 11 in the depression 39 and the releasing portion 28 of the holding member 16 can be easily manipulated in the depression 39.

Similarly, the releasing portion 37 of the holding member 17, which protrudes from the movable arm portion 34 to the outside of the housing 11, has a top end thereof projecting from a corner of the upper external surface portion of the housing 11 to the outside thereof at the end portion of the housing 11 to which the holding member 17 is fixed. A depression 40 is formed at the corner of the upper external surface portion of the housing 11 from which the top end of the releasing portion 37 of the holding member 17 projects to the outside of the housing 11. With the depression 40 thus formed, it is possible to limit the releasing portion 37 so as not to project beyond a portion of the upper external surface portion of the housing 11 positioned around the depression 40. Further, it is also possible to confirm a situation in which the FPC 13 inserted in the housing 11 is surely and appropriately held by the engaging portion 36 of the holding member 17 with visual observation of or finger touch to the top end of the releasing portion 37 of the holding member 17 projecting to the outside of the housing 11 in the depression 40 and the releasing portion 37 of the holding member 17 can be easily manipulated in the depression 40.

When the FPC 13 is inserted into the housing 11 through the opening 12 provided thereon under a condition wherein the housing 11 is mounted on the solid circuit board with the lower external surface portion thereof facing the solid circuit board, the top end portion of the FPC 13 is positioned to be opposite to the opening 12 provided on the front end portion of the housing 11, shown in FIGS. 1 to 3, so that the connecting terminals 15 provided on the FPC 13 are so positioned as to correspond respectively to the conductive contacts 14 arranged on the housing 11.

Figure 5:
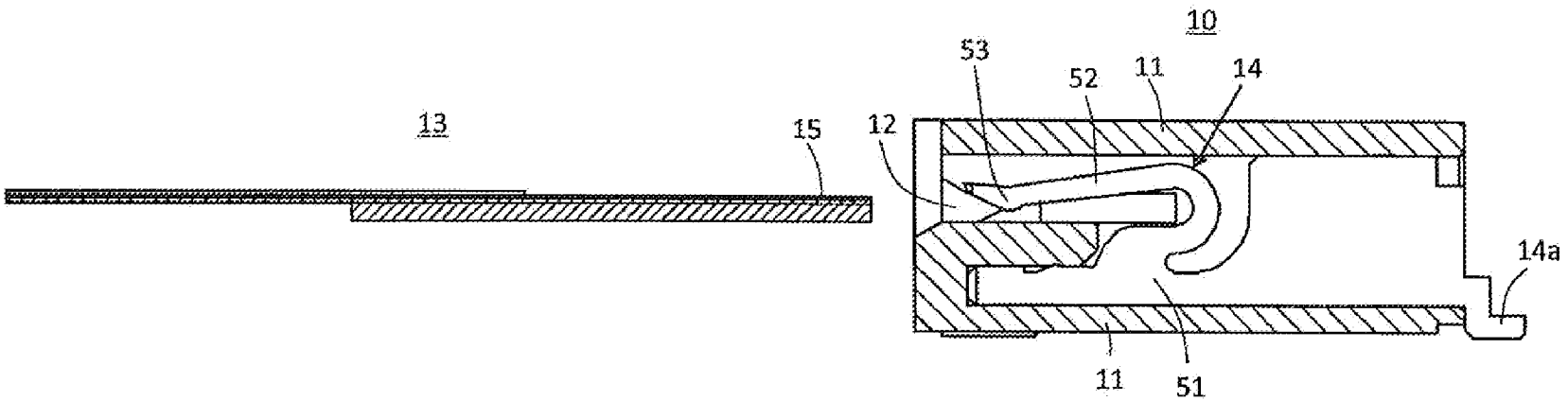
FIG. 5 is a schematic cross sectional view taken along line V-V on FIG. 3.

As shown in FIG. 5 which is a schematic cross sectional view taken along line V-V on FIG. 3, each of the conductive contacts 14 arranged on the housing 11 has a fixed portion 51 operative to be fixed to the housing 11 and a curved arm portion 52 extending from the fixed portion 51. The connecting terminal portion 14*a* extends from the fixed portion 51 to the outside of the housing 11 and a contacting point portion 53 is provided at a top end of the curved arm portion 52.

Figure 6:
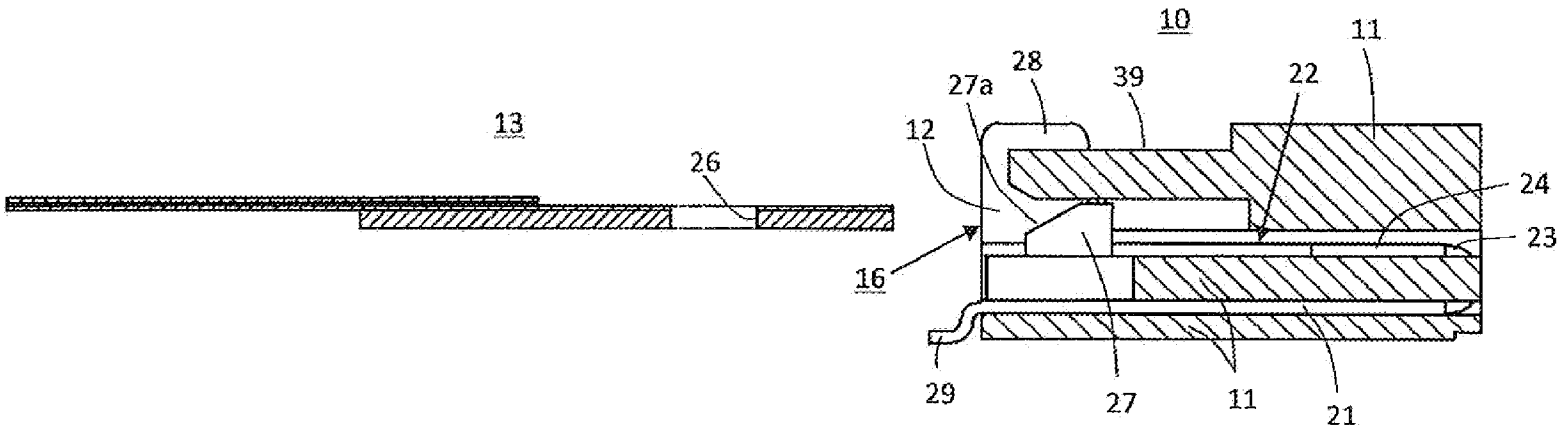
FIG. 6 is a schematic cross sectional view taken along line VI-VI on FIG. 3.
Figure 7:
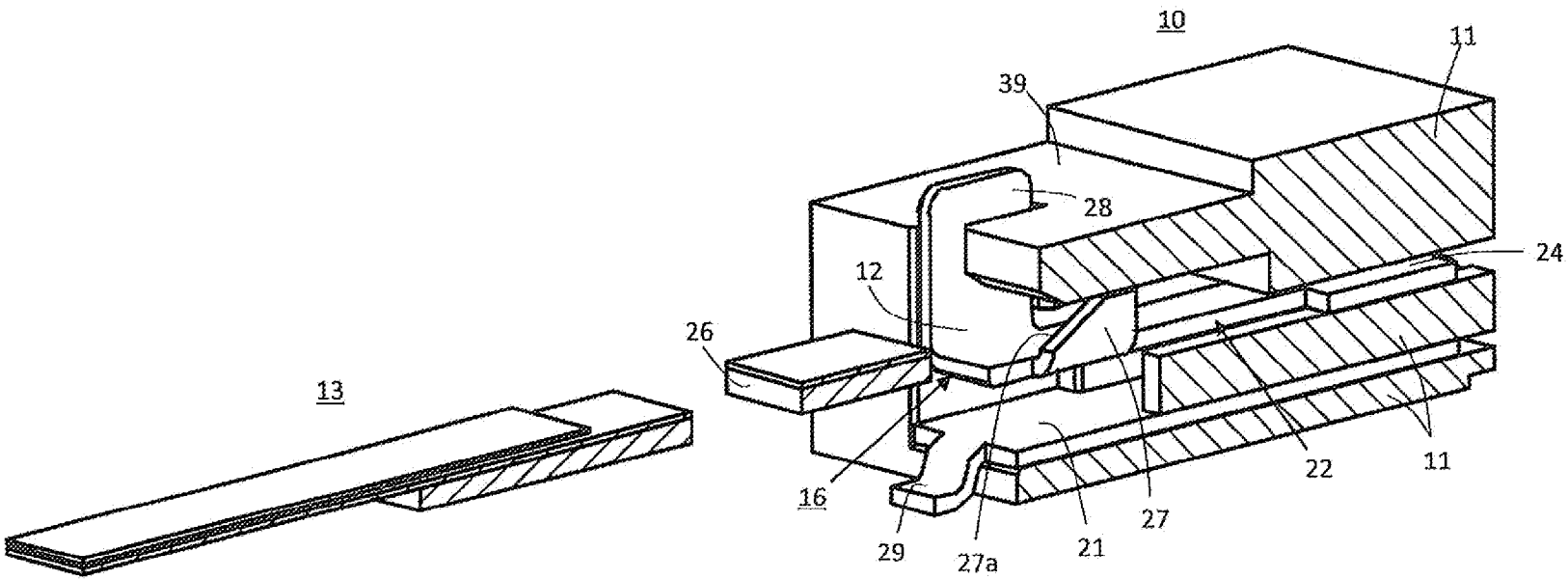
FIG. 7 is a schematic partial perspective view including partial cross sections and showing the embodiment shown in FIG. 1, together with the FPC which is to be inserted into the housing of the embodiment.

At that time, as shown in FIG. 1 and further shown in detail in FIG. 6 which is a schematic cross sectional view taken along line VI-VI on FIG. 3 and in FIG. 7, at the end portion of the housing 11 in which the accommodating rooms 18 is formed, the holding member 16 is provided to have the base portion 21 which is fixed to the housing 11, the slanted end plane 27*a* of the engaging portion 27 provided on the movable arm portion 22, which faces the opening 12 provided on the front end portion of the housing 11, the top end of the releasing portion 28 provided on the movable arm portion 22, which projects from the depression 39 formed on the upper external surface portion of the housing 11 to the outside of the housing 11, and the board connecting portion 29 which extends from the base portion 21 to the outside of the housing 11. The engaging edged recess 26 provided on the FPC 13 is so positioned as to correspond to the engaging portion 27 provided on the movable arm portion 22 of the holding member 16.

Similarly, as shown in FIG. 1, at the end portion of the housing 11 in which the accommodating rooms 19 is formed, the holding member 17 is provided to have the base portion 31 which is fixed to the housing 11, the slanted end plane of the engaging portion 36 provided on the movable arm portion 34, which faces the opening 12 provided on the front end portion of the housing 11, the top end of the releasing portion 37 provided on the movable arm portion 34, which projects from the depression 40 formed on the upper external surface portion of the housing 11 to the outside of the housing 11, and the board connecting portion 38 which extends from the base portion 31 to the outside of the housing 11. The engaging edged recess 35 provided on the FPC 13 is so positioned as to correspond to the engaging portion 36 provided on the movable arm portion 34 of the holding member 17.

After that, the FPC 13 positioned as shown in FIGS. 1 to 3, 5 and 7 is inserted into the housing 11 through the opening 12 provided thereon. On that occasion, first the top end portion of the FPC 13 comes into contact with both of the slanted end plane 27*a* of the engaging portion 27 provided on the movable arm portion 22 of the holding member 16 and the slanted end plane of the engaging portion 36 provided on the movable arm portion 34 of the holding member 17 in the housing 11.

Figure 8:
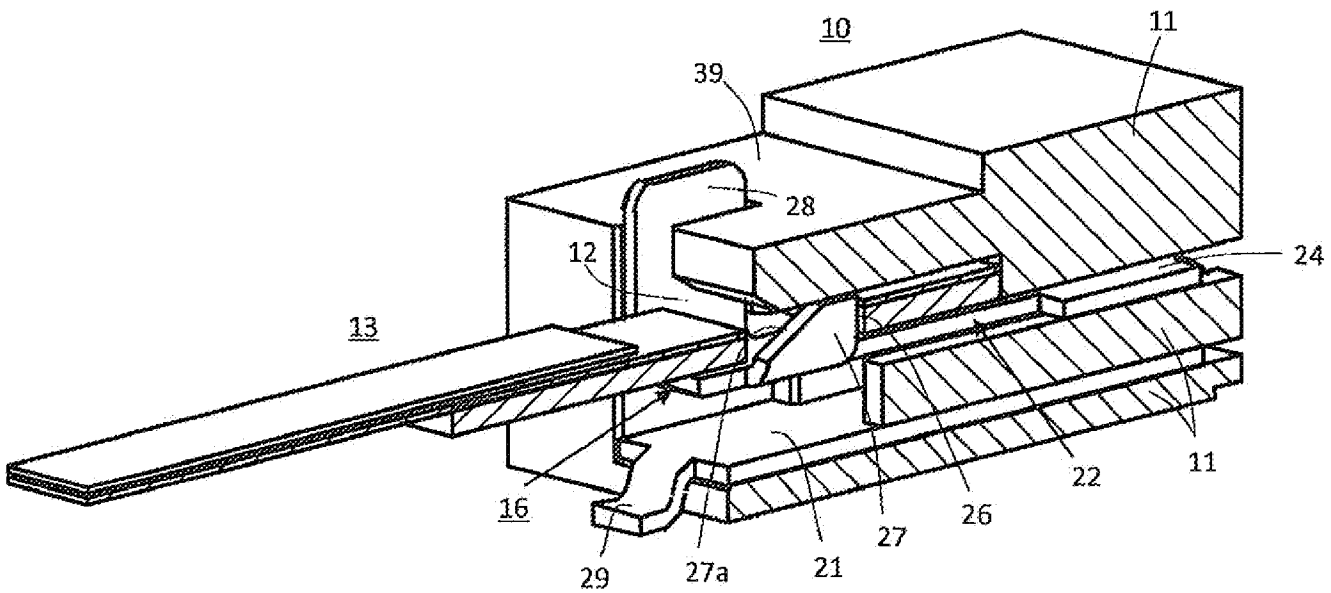
FIG. 8 is a schematic partial perspective view including partial cross sections and showing the embodiment shown in FIG. 1, together with the FPC which has been inserted in the housing of the embodiment and held by a holding member employed in the embodiment.

Then, the top end portion of the FPC 13 is guided by the slanted end plane 27*a* of the engaging portion 27 and the slanted end plane of the engaging portion 36 to ride across the engaging portions 27 and 36. At this time, the movable arm portion 22 of the holding member 16 is temporarily put in resilient deformation to shift in its position so as to approach the base portion 21 of the holding member 16 and the movable arm portion 34 of the holding member 17 is also temporarily put in resilient deformation to shift in its position so as to approach the base portion 31 of the holding member 17. Then, the movable arm portion 22 of the holding member 16 is restored to its condition prior to the resilient deformation by means of its own restoring resilient force and the movable arm portion 34 of the holding member 17 is also restored to its condition prior to the resilient deformation by means of its own restoring resilient force. Thereby, as shown in FIG. 8, the engaging portion 27 of the holding member 16 is put in engagement with the engaging edged recess 26 provided on the FPC 13 to hold the FPC 13 and the engaging portion 36 of the holding member 17 is also put in engagement with the engaging edged recess 35 provided on the FPC 13 to hold the FPC 13.

In such operations of the holding members 16 and 17 as described above, with the movable arm portion 22 of the holding member 16, which is connected through the holding-back portion 23 with the base portion 21 so as to be operative to swing for getting near to or away from the base portion 21 and provided thereon with the contacting portion 24 extending from the holding-back portion 23 to be operative to come into contact with the housing 11, the engaging portion 27 and the releasing portion 28, and the movable arm portion 34 of the holding member 17, which is connected through the holding-back portion 33 with the base portion 31 so as to be operative to swing for getting near to or away from the base portion 31 and provided thereon with the contacting portion extending from the holding-back portion 33 to be operative to come into contact with the housing 11, the engaging portion 36 and the releasing portion 37, the following effect and advantages can be obtained.

The movable arm portion 22 is operative to swing with a fulcrum of swing provided at the contacting portion 24 in contact with the housing 11 and the movable arm portion 34 is also operative to swing with a fulcrum of swing provided at the connecting portion in contact with the housing 11 when the FPC 13 is inserted into the housing 11 through the opening 12 provided thereon. Therefore, the restoring resilient force produced by the swinging movement of the movable arm portion 22 is increased in comparison with a case wherein the movable arm portion 22 is not provided thereon with the contacting portion 24 and the restoring resilient force produced by the swinging movement of the movable arm portion 34 is also increased in comparison with a case wherein the movable arm portion 34 is not provided thereon with the connecting portion, so that clear clicks are obtained when the engaging portion 27 of the holding member 16 engages with the engaging edged recess 26 provided on the FPC 13 and the engaging portion 36 of the holding member 17 engages with the engaging edged recess 35 provided on the FPC 13 and the FPC 13 is surely prevented by the holding members 16 and 17 from getting out of the housing 11 unwillingly. Further, since the fulcrum of swing for each of the movable arm portions 22 and 34 is placed on an extension of the direction along which the FPC 13 is inserted into the housing 11 through the opening 12 provided thereon, the FPC 13 is easily and smoothly inserted into the housing 11 under a condition wherein both of the movable arm portions 22 and 34 are in contact with the FPC 13.

When the engaging portion 27 of the holding member 16 and the engaging portion 36 of the holding member 17 are put in engagement respectively with the engaging edged recesses 26 and 35 provided on the FPC 13, the FPC 13 has been completely inserted into the housing 11 to be placed at a predetermined appropriate position in the housing 11 and held by the engaging portion 27 provided on the movable arm portion 22 of the holding member 16 and the engaging portion 36 provided on the movable arm portion 34 of the holding member 17 so as to be prevented from getting out of the housing 11 unwillingly. This results in that the FPC 13 is automatically held by the engaging portion 27 provided on the movable arm portion 22 of the holding member 16 and the engaging portion 36 provided on the movable arm portion 34 of the holding member 16 so as to be put in a condition to be prevented from getting out of the housing 11 unwillingly only by means of being inserted into the housing 11.

When the FPC 13 inserted in the housing 11 has reached the predetermined appropriate position in the housing 11 to be held by both of the engaging portion 27 provided on the movable arm portion 22 of the holding member 16 and the engaging portion 36 provided on the movable arm portion 34 of the holding member 17, the top end of the releasing portion 28 provided on the movable arm portion 22 of the holding member 16 is positioned to project from the depression 39 to the outside of the housing 11, as shown in FIG. 8, and the top end of the releasing portion 37 provided on the movable arm portion 34 of the holding member 17 is positioned to project from the depression 40 to the outside of the housing 11. Therefore, a situation wherein the FPC 13 inserted in the housing 11 has reached the predetermined appropriate position in the housing 11 to be held by both of the engaging portion 27 of the holding member 16 and the engaging portion 36 of the holding member 17 can be confirmed by means of visual observation of or finger touch on the top end of the releasing portion 28 or the top end of the releasing portion 37 from the outside of the housing 11.

Under a condition wherein the FPC 13 inserted in the housing 11 takes up the predetermined appropriate position in the housing 11 in the manner described above, the contacting point portion 53 provided at the top end of the curved arm portion 52 of each of the conductive contacts 14 arranged on the housing 11 comes into resilient press-contact with one of the connecting terminals 15 provided on the FPC 13, so that the conductive contacts 14 are electrically connected respectively with the connecting terminals 15 provided on the FPC 13. As a result, the connecting terminals 15 provided on the FPC 13 inserted in the housing 11 are electrically connected through the conductive contacts 14 with the circuit terminals provided on the solid circuit board on which the housing 11 is mounted. Such a condition that the connecting terminals 15 provided on the FPC 13 are electrically connected through the conductive contacts 14 with the circuit terminals provided on the solid circuit board as mentioned above is automatically obtained when the FPC 13 is appropriately inserted into the housing 11.

Figure 9:
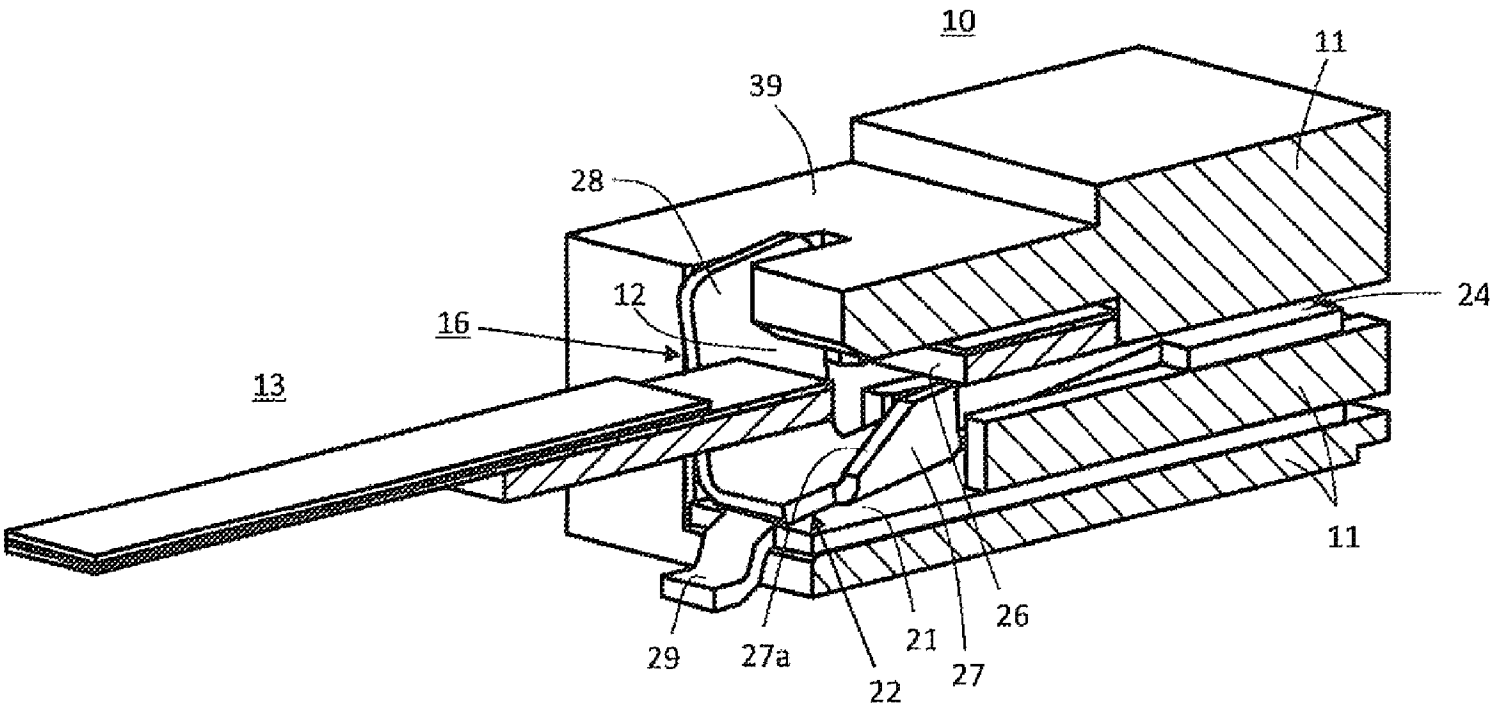
FIG. 9 is a schematic partial perspective view including partial cross sections and showing the embodiment shown in FIG. 1, together with the FPC which is released from holding by the holding member employed in the embodiment.

After that, as shown in FIG. 9, when the top end of the releasing portion 28 provided on the movable arm portion 22 of the holding member 16, which is positioned to project from the depression 39 formed on the upper external surface portion of the housing 11 to the outside of the housing 11, is manipulated to be pushed into the housing 11, the movable arm portion 22 of the holding member 16 is resiliently deformed to shift in its position so as to cause the engaging portion 27 provided thereon to approach the base portion 21 of the holding member 16. As a result, the engaging portion 27 of the holding member 16 is disengaged from the engagement with the engaging edged recess 26 provided on the FPC 13 so that the FPC 13 is released from holding by the engaging portion 27. That is, the releasing portion 28 provided on the movable arm portion 22 of the holding member 16 is operative to move the movable arm portion 22 so as to cause the engaging portion 27 provided on the movable arm portion 22 to release the FPC 13 from the holding thereby when the top end of the releasing portion 28 projecting from the depression 39 to the outside of the housing 11 is manipulated to be pushed into the housing 11.

Similarly, when the top end of the releasing portion 37 provided on the movable arm portion 34 of the holding member 17, which is positioned to project from the depression 40 formed on the upper external surface portion of the housing 11 to the outside of the housing 11, is manipulated to be pushed into the housing 11, the movable arm portion 34 of the holding member 17 is resiliently deformed to shift in its position so as to cause the engaging portion 36 provided thereon to approach the base portion 31 of the holding member 17. As a result, the engaging portion 36 of the holding member 17 is disengaged from the engagement with the engaging edged recess 35 provided on the FPC 13 so that the FPC 13 is released from holding by the engaging portion 36. That is, the releasing portion 37 provided on the movable arm portion 34 of the holding member 17 is operative to move the movable arm portion 34 so as to cause the engaging portion 36 provided on the movable arm portion 34 to release the FPC 13 from the holding thereby when the top end of the releasing portion 37 projecting from the depression 40 to the outside of the housing 11 is manipulated to be pushed into the housing 11.

With the engaging portion 27 provided on the movable arm portion 22 of the holding member 16 and the engaging portion 36 provided on the movable arm portion 34 of the holding member 17 each caused to release the FPC 13 from the holding thereby as mentioned above, the FPC 13 inserted in the housing 11 is put in a condition to be able to get out of the housing 11 appropriately.

Although the FPC 13 described above is provided with the engaging edged recesses 26 and 35, it is also possible for the FPC 13 to have a couple of engaging holes in place of the engaging edged recesses 26 and 35. In the case where the engaging holes are provided on the FPC 13 in place of the engaging edged recesses 26 and 35, the FPC 13 inserted in the housing 11 is also held by both of the engaging portion 27 provided on the movable arm portion 22 of the holding member 16 and the engaging portion 36 provided on the movable arm portion 34 of the holding member 17 in the same manner as mentioned above.

With the electrical connector 10 constituting the embodiment of electrical connector according to the present invention as described above, when the FPC 13 is inserted into the housing 11 thorough the opening 12 provided thereon, such a condition that the connecting terminals 15 provided on the FPC 13 inserted in the housing 11 are electrically connected through the conductive contacts 14 arranged on the housing 11 with the circuit terminals provided on the solid circuit board on which the housing 11 is mounted and the FPC 13 inserted in the housing 11 is appropriately held by both of the engaging portion 27 provided on the movable arm portion 22 of the holding member 16 and the engaging portion 36 provided on the movable arm portion 34 of the holding member 17 so as to be prevented from getting out of the housing 11 unwillingly, can be obtained automatically.

Further, it is not required, for causing each of the holding members 16 and 17 to be put in engagement with the FPC 13 inserted in the housing 11 to hold the same and then to be released from the engagement with the FPC 13 to put the same in the condition to be able to get out of the housing 11 appropriately, to provide on the housing 11 an actuator rotatable in regard to the housing 11 or the like or to provide a conductive shell movable in regard to the housing 11. Accordingly, the electrical connector 10 can be constituted with a relatively small number of constitutive parts and at a production cost reduced effectively.

In the electrical connector 10, the holding member 16, which is provided for holding the FPC 13 inserted in the housing 11 through the opening 12 provided thereon and then for releasing the FPC 13 from the holding by the holding member 16, is constituted to have the base portion 21 provided to be fixed to the housing 11 and the movable arm portion 22 extending from the base portion 21 to be provided thereon with the engaging portion 27 operative to be put in the engagement with the FPC 13 inserted in the housing 11 so as to hold the same and the releasing portion 28 protruding from the movable arm portion 22 to the outside of the housing 11 for causing the movable arm portion 22 to move for releasing the engaging portion 27 from the engagement with the FPC 13 when the releasing portion 28 is manipulated to be shifted in its position, and similarly. the holding member 17, which is provided for holding the FPC 13 inserted in the housing 11 through the opening 12 provided thereon and then for releasing the FPC 13 from the holding by the holding member 17, is constituted to have the base portion 31 provided to be fixed to the housing 11 and the movable arm portion 34 extending from the base portion 31 to be provided thereon with the engaging portion 36 operative to be put in the engagement with the FPC 13 inserted in the housing 11 so as to hold the same and the releasing portion 37 protruding from the movable arm portion 34 to the outside of the housing 11 for causing the movable arm portion 34 to move for releasing the engaging portion 36 from the engagement with the FPC 13 when the releasing portion 37 is manipulated to be shifted in its position. Therefore, each of the holding members 16 and 17 can be obtained with a relatively simplified constitution in which the engaging portion 27 or 36 and the releasing portion 28 or 37 are formed in a body.

In addition, in the electrical connector 10, since each of the engaging portion 27 of the holding member 16 and the engaging portion 36 of the holding member 17 is automatically put in the engagement with the FPC 13 to hold the same in the housing 11 when the FPC 13 is inserted in the housing 11 through the opening 12 provided thereon and then each of the engaging portion 27 of the holding member 16 and the engaging portion 36 of the holding member 17 is released from the engagement with the FPC 13 inserted in the housing 11 when each of the releasing portion 28 of the holding member 16 and the releasing portion 37 of the holding member 17 each protruding to the outside of the housing 11 is manipulated to be pushed into the housing 11, the FPC 13 inserted in the housing 11 can be held by both of the holding members 16 and 17 and then released from the holding by the holding members 16 and 17 in the housing 11 with extremely simple and easy operations and it is not necessary for carrying out such operations to provide an undesirable open space around each of the releasing portion 28 of the holding member 16 and the releasing portion 37 of the holding member 17.

The invention claimed is:

1. An electrical connector comprising;

a housing made of insulator to be mounted on a solid circuit board and provided thereon with an opening through which a flat circuit device is inserted into the housing, a plurality of conductive contacts arranged on the housing to be electrically connected respectively with circuit terminals provided on the solid circuit board and positioned to correspond respectively to connecting terminals provided on the flat circuit device inserted in the housing through the opening provided thereon, and a holding member attached to the housing to be operative to hold the flat circuit device inserted in the housing through the opening provided thereon and then to release the flat circuit device from holding by the holding member, wherein the holding member has a base portion provided to be fixed to the housing and a movable arm portion extending from the base portion, and the movable arm portion is provided thereon with an engaging portion operative to be put in engagement with the flat circuit device inserted in the housing so as to hold the same and a releasing portion protruding from the movable arm portion to the outside of the housing and is operative to move for releasing the engaging portion from the engagement with the flat circuit device when the releasing portion is manipulated to be shifted in position.

2. An electrical connector according to claim 1, wherein the holding member is made of metallic material to have a board connecting portion provided for extending from the base portion to the outside of the housing to be soldered to a conductive portion provided on the solid circuit board on which the housing is mounted.

3. An electrical connector according to claim 1, wherein an end portion of each of the conductive contacts projects from one of end portions opposite to each other of the housing to the outside of the housing to be soldered to a circuit terminal provided on the solid circuit board on which the housing is mounted and the board connecting portion of the holding member projects from the other of end portions opposite to each other of the housing to the outside of the housing to be soldered to the conductive portion provided on the solid circuit board on which the housing is mounted.

4. An electrical connector according to claim 1, wherein a depression is formed at a part of an external surface portion of the housing from which the releasing portion provided on the movable arm portion of the holding member protrudes to the outside of the housing.

5. An electrical connector according to claim 1, wherein the movable arm portion of the holding member is connected through a holding-back portion with the base portion so as to be operative to swing for getting near to or away from the base portion and provided thereon with a contacting portion extending from the holding-back portion to operative to come into contact with the housing.

6. An electrical connector according to claim 1, wherein the engaging portion of the holding member has a slanted end plane formed thereon to ascends gradually in a direction along which the flat circuit device is inserted into the housing through the opening provided thereon and a part of the engaging portion on which the slanted end plane is formed is operative to engage with the flat circuit device inserted in the housing.

7. An electrical connector according to claim 1, wherein a couple of holding members are attached respectively to both end portions of the housing aligned in a direction along which the conductive contacts are arranged.

* * * * *